United States Patent [19]

Wong et al.

[11] Patent Number: 4,860,020

[45] Date of Patent: Aug. 22, 1989

[54] COMPACT, WIDEBAND ANTENNA SYSTEM

[75] Inventors: Jimmy L. Y. Wong, Redondo Beach; Howard E. King, Gardena, both of Calif.

[73] Assignee: The Aerospace Corporation, El Segundo, Calif.

[21] Appl. No.: 44,381

[22] Filed: Apr. 30, 1987

[51] Int. Cl.[4] ..... H01Q 9/30

[52] U.S. Cl. ..... 343/828; 343/826; 343/834; 343/833

[58] Field of Search ..... 343/828, 705, 708, 790, 343/791, 803, 806, 825, 826, 829, 831, 833, 834

[56] References Cited

U.S. PATENT DOCUMENTS

| | | | |
|---|---|---|---|
| 1,745,342 | 1/1930 | Yagi | 343/834 |
| 2,045,987 | 6/1936 | Green | 343/803 |
| 2,417,793 | 3/1947 | Wehner | 343/826 |
| 2,418,961 | 4/1947 | Wehner | 343/791 |
| 4,313,121 | 1/1982 | Campbell et al. | 343/828 |
| 4,521,781 | 6/1985 | Campi et al. | 343/700 MS |

FOREIGN PATENT DOCUMENTS

| | | | |
|---|---|---|---|
| 5612102 | 2/1981 | Japan | 343/828 |

OTHER PUBLICATIONS

E. L. Bock, J. A. Nelson, A. Dorn, "Sleeve Antennas", Very High Frequency Techniques, Radio Research Lab Staff, Harvard University, vol. 1, Ch. 5, p. 119, McGraw Hill, 1947.

H. B. Barkley, "The Open-Sleeve As a Broadband Antenna", TR No. 14, U.S. Naval Postgraduate School, Monterey, CA, Jun. 1955.

H. E. King, J. L. Wong, "An Experimental Study of a Balun-Fed., Open Sleeve Dipole in Front of a Metallic Reflector", IEEE, Trans. Antennas & Propagation, AP-20, Mar. 1972; pp. 201-204.

J. L. Wong, H. E. King, "Broadband Characteristics of an Open-Sleeve Dipole", 1972 IEEE, G-AP International Symposium Digest, Williamsburg, VA, 11-14, Nov. 1972; pp. 332-335.

J. L. Wong, H. E. King, "Design Variations & Performance Characteristics of the Open-Sleeve Dipole", The Aerospace Corporation, Report No. TR 0073, (3404)-2; 01/15/73.

*Primary Examiner*—Rolf Hille
*Assistant Examiner*—Hoanganh Le
*Attorney, Agent, or Firm*—William J. Burke

[57] ABSTRACT

A compact, wideband antenna system is provided by an open-sleeve, meander dual zigzag monopole consisting of a driven element configured from two symmetrically-oriented meander wires fed from a common feed point and one or two closely-spaced parasitic elements (open sleeves), also configured from two meander wires and shorted to ground plane. The meander monopole has a low silhouette and provides approximately 50% reduction in height as compared to a conventional monopole. By varying the size, geometry, and location of the open sleeves, antennas are synthesized to achieve specific frequency response characteristics. Measurements have demonstrated that the meander monopole is capable of providing the desired radiation pattern characteristics over a 3:1 frequency band.

4 Claims, 6 Drawing Sheets

3 (a)

3 (b)

3 (c)

COMPACT, WIDEBAND ANTENNA SYSTEM

STATEMENT OF GOVERNMENT INTEREST

The invention described herein may be manufactured and used by or for the Government of the United States for governmental purposes without the payment of royalty therefor.

BACKGROUND OF THE INVENTION

1. Field of the Invention

This invention relates to monopole antennas and in particular to wideband monopole antennas which are reduced in size.

2. Description of the Prior Art

Monopole antennas are generally constructed as straight, vertical wires mounted above the ground plane and fed with a coaxial line at the input. As shown in FIG. 1, the narrowband monopole antenna 2 is fed by a coaxial line 4 and resonates when the length of the antenna above the ground plane 6 is equal to a quarter of a wavelengty $\lambda/4$.

Since $\lambda$ is inversely related to frequency, as frequency decreases, $\lambda$ increases. Thus, a wave wight a frequency of 300 MHz and a $\lambda$ of about 1 meter requires a resonant monopole antenna about 0.25 meters long. A significant shortcoming of conventional monopole antennas is that it cannot be used in situations where space is limited.

For example, a resonant antenna located within the body of a spacecraft may be required to fit within a space which is about 1 meter square. Since a 50 MHz wave has a $\lambda$ of 6 meters, a conventional resonant monopole antenna must be $\lambda/4$ in length or about 1.5 meters. That dimension would clearly exceed the dimensions of the hypothetical spacecraft.

A second shortcoming of a conventional monopole antenna is that it can function only as a narrow band antenna. While wide band performance can be achieved by adding additional single monopole antennas, these additional antennas require more space, further limiting the use of conventional monopole antennas.

A great deal of research and development has been devoted to the development of size-reduced, wideband antennas. However, none of the size-reduced, wire-type antennas possess wide bandwidth impedance characteristics. Previous works on reduced height monopoles include: (1) wire structure with top loading as a T structure or inverted L configuration (E. C. Jordan, *Electromagnetic Waves and Radiating Systems,* Ch. 14, "Antenna Practice and Design," p. 512, Prentice-Hall, 1950); (2) helical monopoles constructed with a wire wound in a helic (M. Eovine, "Helical Monopole HF Antenna", Chu Associates, Littleton, MA, Final Report, 15 Oct. 1962, DDC No. AD 288270); (3) $\lambda/8$ monopole blade antennas with strip transmission line radiators and resonant broadbanding circuits (T. Kitsuregawa, Y. Takeichi, M. Mizusawa, "A One Eighth Wave Broadband Folded Unipole Antenna," Electromagnetic Theory and Antennas, Symposium Proceedings, Copenhagen, Denmark, June 1962, Vol. 6, Pt. 2, Pergamon Press. Ed. E. C. Jordan); (4) a variable length, multi-element monopole with wave traps (W. A. Edson, "Broadband Trapped Multiple-Wire Antennas," IEEE Symposium Digest, Antennas and Propagation Society, 1981, pp. 586–589) and; (5) a $\lambda/8$ wide-angle conical monopole (C. H. Papas, R. W. P. King, "Input Impedance of Wide Angle Conical Antennas Fed by a Coaxial Line," Proc. IRE, November 1949, pp. 1269–1271). Although all of the past wire-class monopole results approach a 50% reduction in height, they have a limitation of a narrow bandwidth response.

It is therefore an object of this invention to provide an antenna system which is reduced in size from a single monopole antenna.

It is also an object of this invention to provide a reduced size antenna system which has a wide bandwidth response.

It is another object of this invention to provide an antenna system which is efficient and has a wide useable voltage standing wave ratio (VSWR) and pattern bandwidths.

It is a further object of this invention to provide an antenna system design which is easily fabricated and can be readily varied to optimize antenna efficiency and desired performance characteristics.

SUMMARY OF THE INVENTION

A compact, wideband antenna system is provided by a meander zigzag monopole antenna configured from one or more meander wires fed from a common feed point. One or more open sleeves configured in a similar dual meander fashion are also provided to extend the antenna bandwidth.

DETAILED DESCRIPTION OF THE PREFERRED EMBODIMENT

The antenna system consists of a driven element fed from a coaxial line and one or more closely space dparasitic elements, termed open sleeves, shorted to a ground plane. The basic element is constructed of a meander wire in a zigzag configuration with alternating vertical and horizontal sections. Although a single zigzag configuration will function effectively as a monopole, a dual zigzag configuration with wires of uniform cross-section is preferred to provide symmetry and to reduce cross polarization distortion. For this reason, the antenna system of the present invention may be described as a meander dual zigzag monopole.

Figure 1:
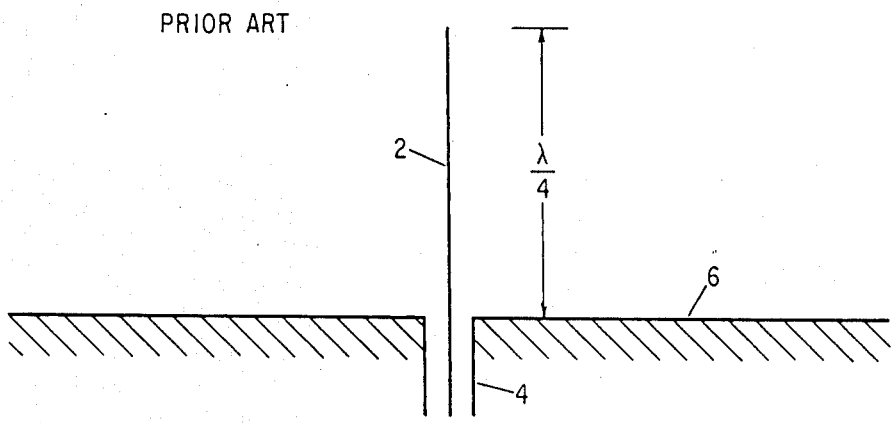
FIG. 1 is an illustration of a conventional monopole antenna.
Figure 2:
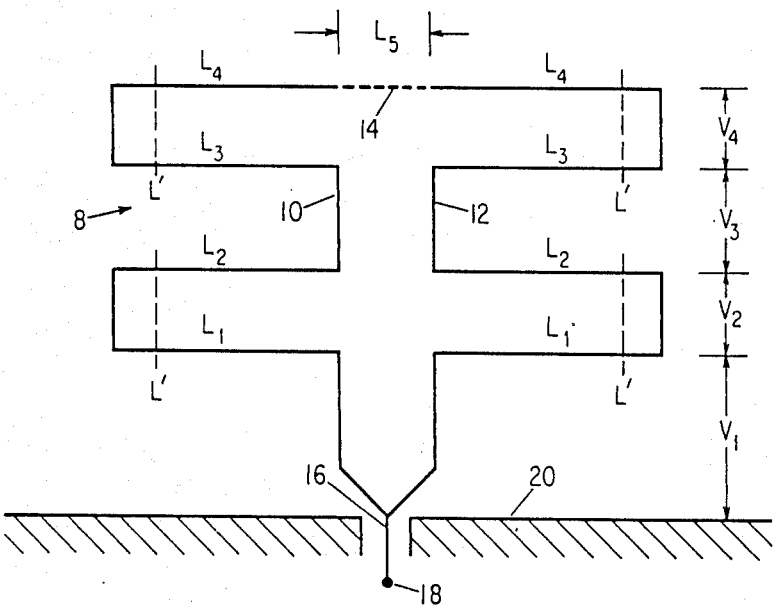
FIG. 2 is an illustratio of the present invention showing a meander dual zigzag monopole antenna.

A meander dual zigzag monopole antenna 8 is illustrated in FIG. 2. Two meander wires 10, 12 are shaped into a zigzag configuration of height $V_1+V_2+V_3+V_4$ above ground plane 20. For each wire 10, 12 horizontal sections $L_1$, $L_2$, $L_3$ and $L_4$ alternate with vertical sections $V_1$, $V_2$, $V_3$ and $V_4$. The meander wires are separated by a distance $L_5$, but in some applications, a connection 14 may be used to join the meander wires at the top of the configuration. A connection 16 joins the wires 10, 12 to become a common feed point 18. A single length of wire may be used in place of two separate wires 10, 12.

The geometry of the wires can be modified to obtain the desired bandwidth characteristics. The total length of each of the wires will generally exceed $\lambda/4$ to compensate for the increased capacitive antenna reactance caused by the height reduction.

The invention can be made even more compact by bending the horizontal sections $L_1$, $L_2$, $L_3$ and $L_4$ at points L'. Bending permits the antenna of the present invention to fit into spaces which are limited in width as well as in height.

The concept of the meander wire monopole is based on at least three mechanisms, each of which serves to eliminate or greatly minimize the undesirable, cross-polarized component of the fields radiating from the meander wires. These mechanisms are as follows: (1) the currents flowing on the meander wires are in a zigzag path, and the fields radiated by the adjacent horizontal segments tend to cancel each other; (2) the horizontal wires in the dual zigzag configuration have currents that are spatially out of phase and the radiated fields subtract one another; and (3) since the monopole is mounted above a ground plane and at a low height, the field produced by the horizontal image currents are in phase opposition with the direct fields and thus tend to cancel one another.

Based on the above, the resultant radiation from the horizontal segments of the meander wires is expected to be negligibly small. The main contribution to radiation is due to the currents on the vertical segments, and the far field pattern should tus resemble that of a conventional straight wire monopole.

Figure 4:
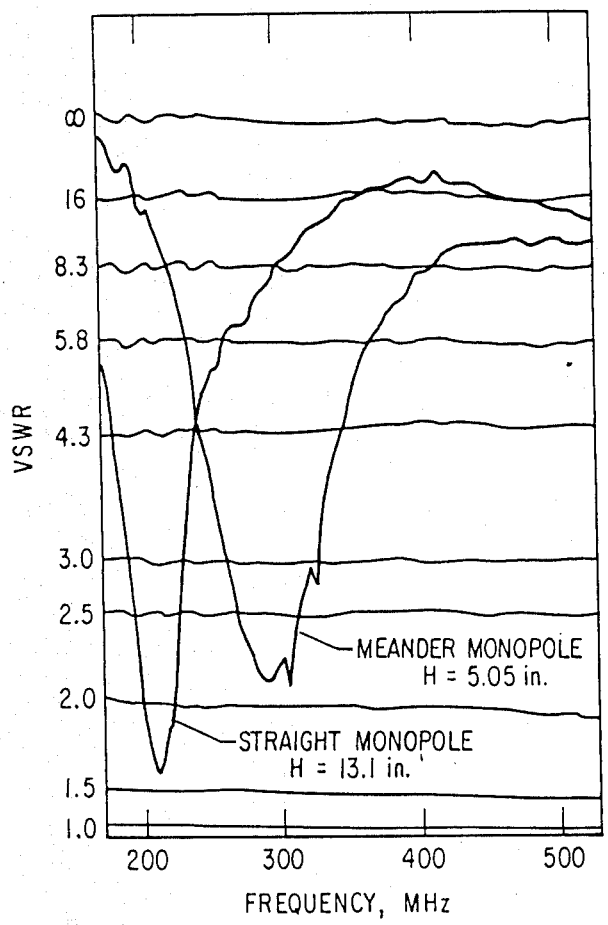
FIG. 4 compares the voltage standing wave ratio (VSWR) of the first example embodiment with the VSWR of a straight monopole of equal length.

In a first example embodiment operating in the 265 to 310 MHz band, a driven element constructed from number 12 wire is mounted on a ground plane which is 48 inches in diameter. For this configuration, $V_1=3.55$ in., $V_2=V_3=V_4=0.5$ in., $L_1=L_2=L_3=L_4=2.0$ in. and $L_5=0.5$ in. The height of this configuration above the ground plane is about 5.05 inches. FIG. 4 illustrates a voltage standing wave ratio (VSWR) for this configuration which contains only a driven element with no sleeves. FIG. 4 shows that this configuration regenerates at approximately 290 MHz. Thus, the invention represents a 50 percent reduction from the normal resonant $\lambda/4$ height of about 10.2 inches required for a frequency of 290 Mhz. The total length of wire in this embodiment is 13.1 inches. FIG. 4 illustrates the VSWR response of a 13.1 inch long straight wire monopole for comparison.

Figure 3:
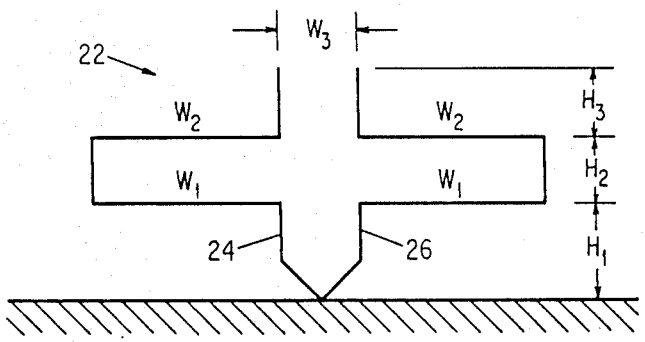
FIG. 3*a* illustrates the configuration of a first parasitic sleeve.
FIG. 3*b* illustrates the configuration of a second parasitic sleeve and FIG. 3*c* is a side view of a driven element with a first sleeve and a second sleeve.
Figure 3:
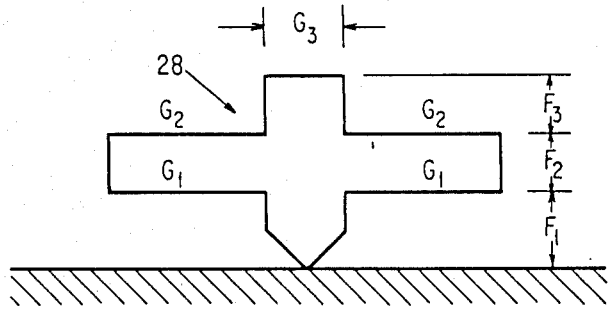
Figure 3:
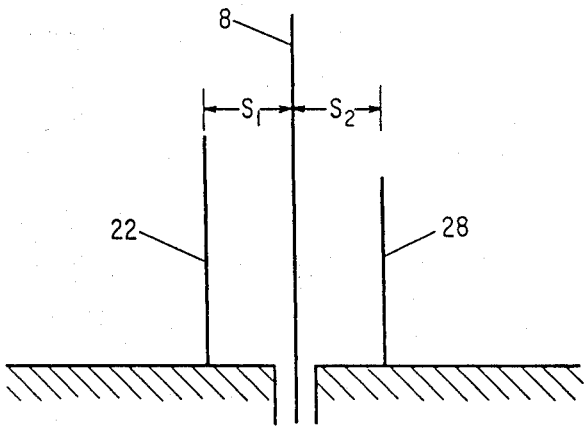

FIG. 3 illustrates that the bandwidth performance of a simple dual zigzag meander wire monopole is narrow, similar to that of a straight wire monopole. However, the bandwidth of the present invention can be significantly extended by the addition of one or more closely spaced parasitic elements or open sleeves. For the meander wire monopole, the sleeves are also constructed in dual zigzag configuration smaller to the drive element. The dimensions of the sleeves can then be adjusted to optimize the VSWR performance over a specified bandwidth. In addition, the horizontal sections W and G of the sleeves can be bent in the same way that the horizontal sections L of the driven element are bent. FIG. 3*a* illustrates the configuration of a parasitic sleeve 22 which is used to extend the bandwidth. Two wires, 24 and 26 have horizontal sections $W_1$ and $W_2$ which alternate with vertical sections $H_1$, $H_2$ and $H_3$. The wires are separated at the end opposite the ground by a distance $W_3$. FIG. 3*b* illustrates the configuration of a second parasitic sleeve 28 which extends the bandwidth even further. Here, horziontal sections, $G_1$, $G_2$ alternate with vertical sections $F_1$, $F_2$ and $F_3$. Unlike the first sleeve, the second sleeve is joined at the top by connection $G_3$. FIG. 3*c* shows a side view of a driven element 8 in conjunction with a first sleeve 22 and a second sleeve 28 which are set on ground plane and are separated from driven element 8 by separation distances $S_1$ and $S_2$, respectively. In an alternate embodiment not shown in FIGS. 3*a* and 3*b*, sections $W_2$ and $W_3$ are deleted from the first sleeve 22 and section $F_3$ is deleted from the second sleeve 28.

Figure 5:
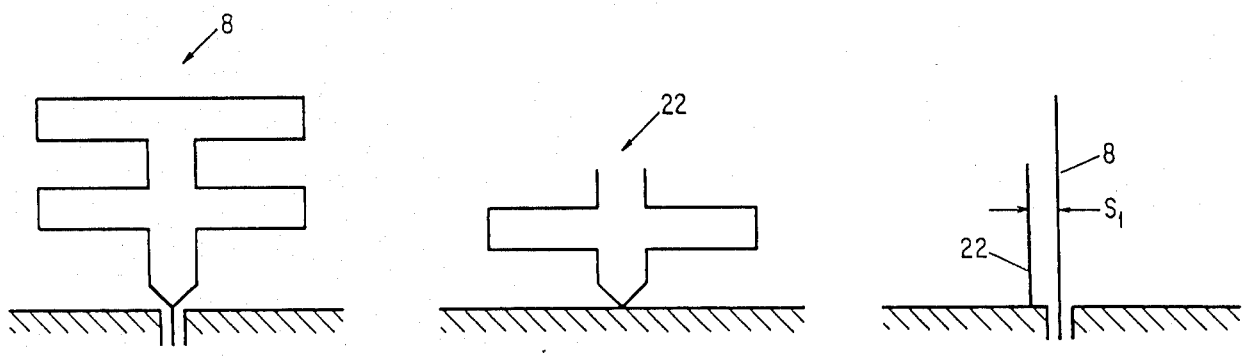
FIG. 5 shows a second example embodiment with one open sleeve.
Figure 6:
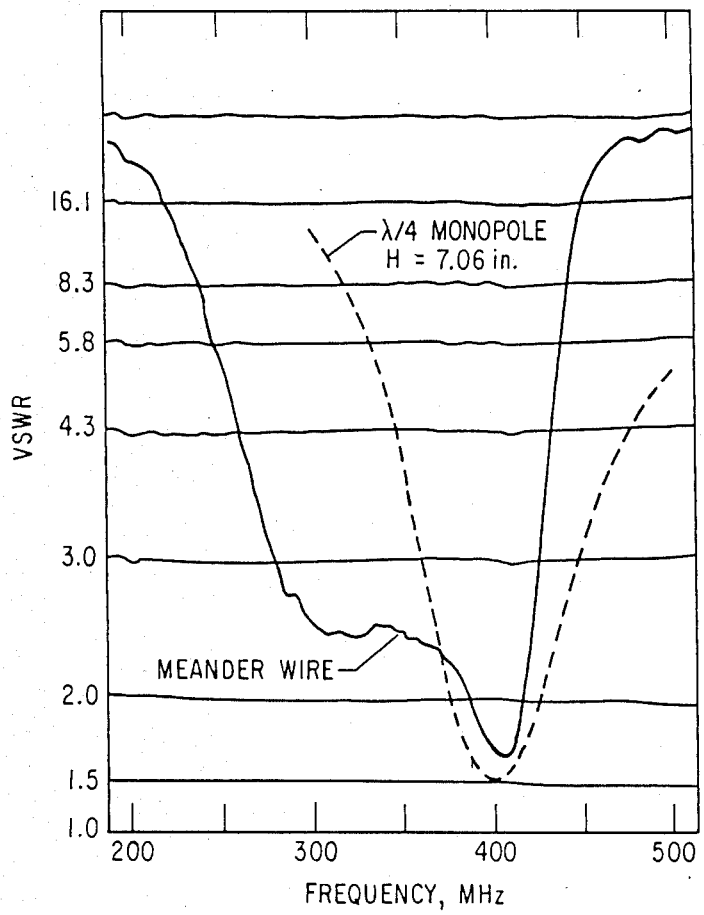
FIG. 6 compares the VSWR of the second example embodiment with the VSWR of a $\lambda/4$ straight monopole.

Two example embodiments with sleeves are shown below. A preferred embodiment of a 1.53:1 bandwidth antenna (275 to 420 MHz) with one open sleeve is shown in FIG. 5. Its dimensions are as follows: $V_1=2.0$ in., $V_2=1.0$ in., $V_3=1.5$ in., $V_4=1.0$ in., $L_1=L_2=L_3=L_4=2.0$ in. and $L_5=0.5$ in. Note that connection 14 is in place. The height of this configuration is 5.5 inches and one sleeve has been added. The dimensions of the sleeve configured as shown in FIG. 3*a* are as follows: $H_1=2.0$ in., $H_2=1.0$ in., $H_3=0.3$ in., $W_1=W_2=2.0$ in., $W_3=0.5$ in. and $S_1=0.3$ in. This antenna system with sleeve operates in the 275 to 420 MHz band. The VSWR of this embodiment is shown in FIG. 6. FIG. 6 shows that a VSWR of less than or equal to 3:1 can be achieved in the bandwidth between 275 to 420 MHz. For comparison, the VSWR of a $\lambda/4$ conventional monopole with a height of 7.06 inches is also shown.

Figure 7:
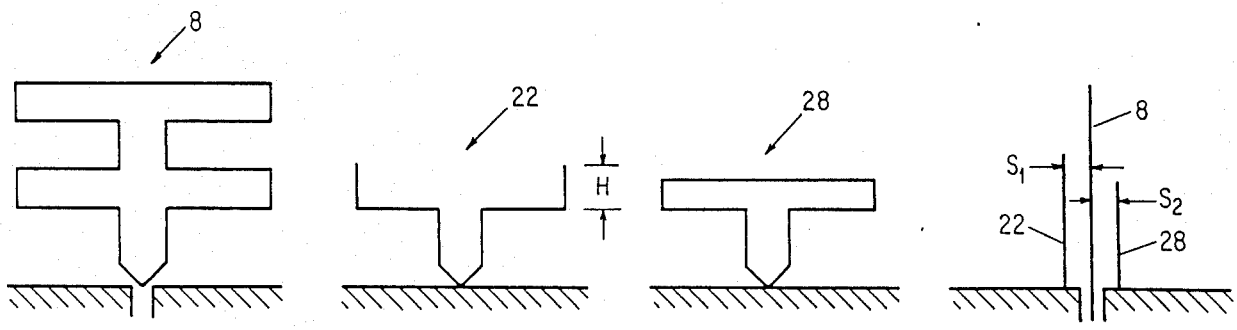
FIG. 7 shows a third example embodiment with two open sleeves.
Figure 8:
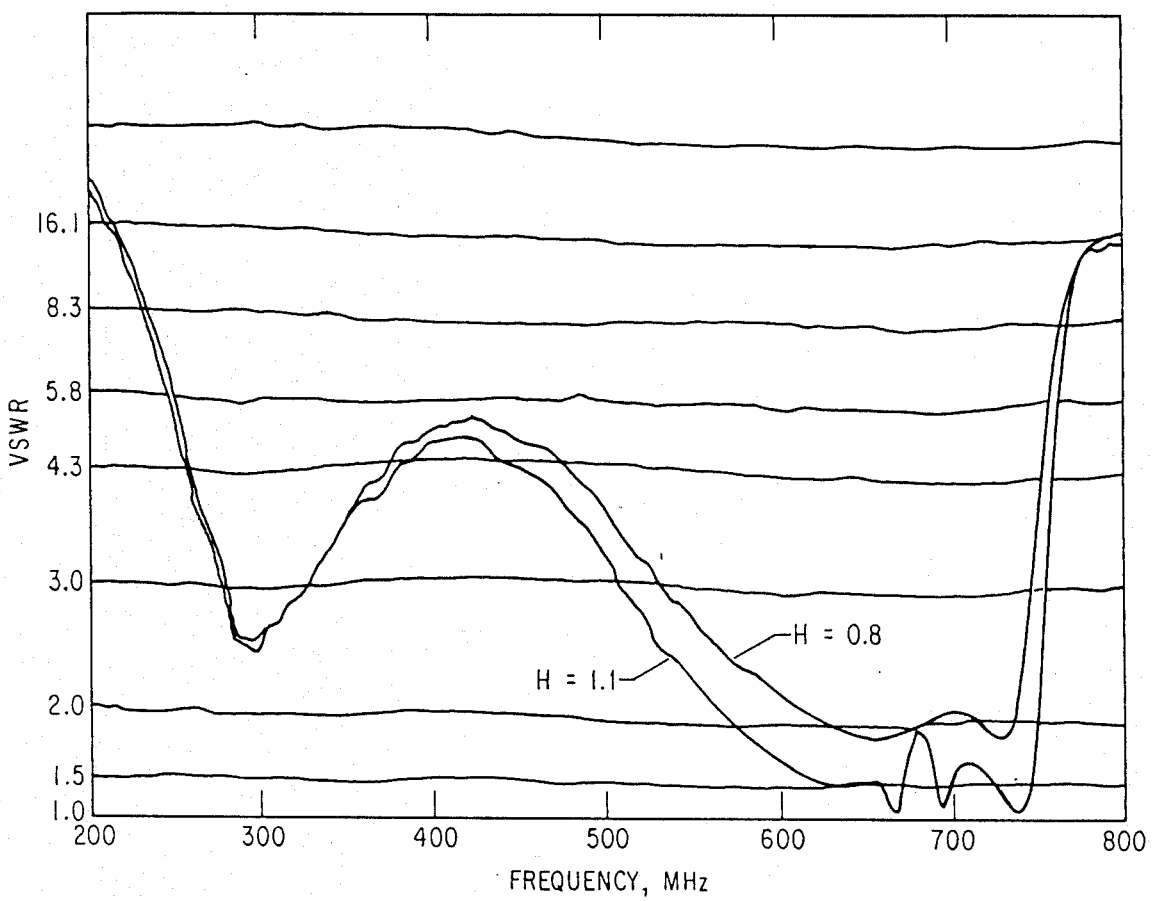
FIG. 8 compares the VSWR of the third example embodiment with $H=0.8$ and $H=1.1$.

An embodiment of a 3:1 bandwidth antenna (250 to 750 MHz) with two open sleeves is shown in FIG. 7. The first sleeve has a vertical section of height H. In the first sleeve, $H_1=1.9$ in., $H_2=H$, $H_3=0$, $W_1=1.25$ in., $W_2=0$, WHD $3=0.5$ in. In the second sleeve, $F_1=1.9$ in., $F_2=0.5$ in., $F_3=0$, $G_1=G_2=1.0$ in., $G_3=0.5$ in., $S_1=S_2=0.5$ in. This antenna system with two parasitic sleeves operates in the 250 to 750 MHz band. FIG. 8 shows the VSWR of this embodiment for two different values of H: $H=0.8$ inches and $H=1.1$ inches. FIG. 8 illustrates that this configuration exhibits two distinct resonances and is especially useful for systems requiring operation over two broad frequency bands. Furthermore, the VSWR is less than 5.5:1 over the entire 3:1 band.

Figure 9:
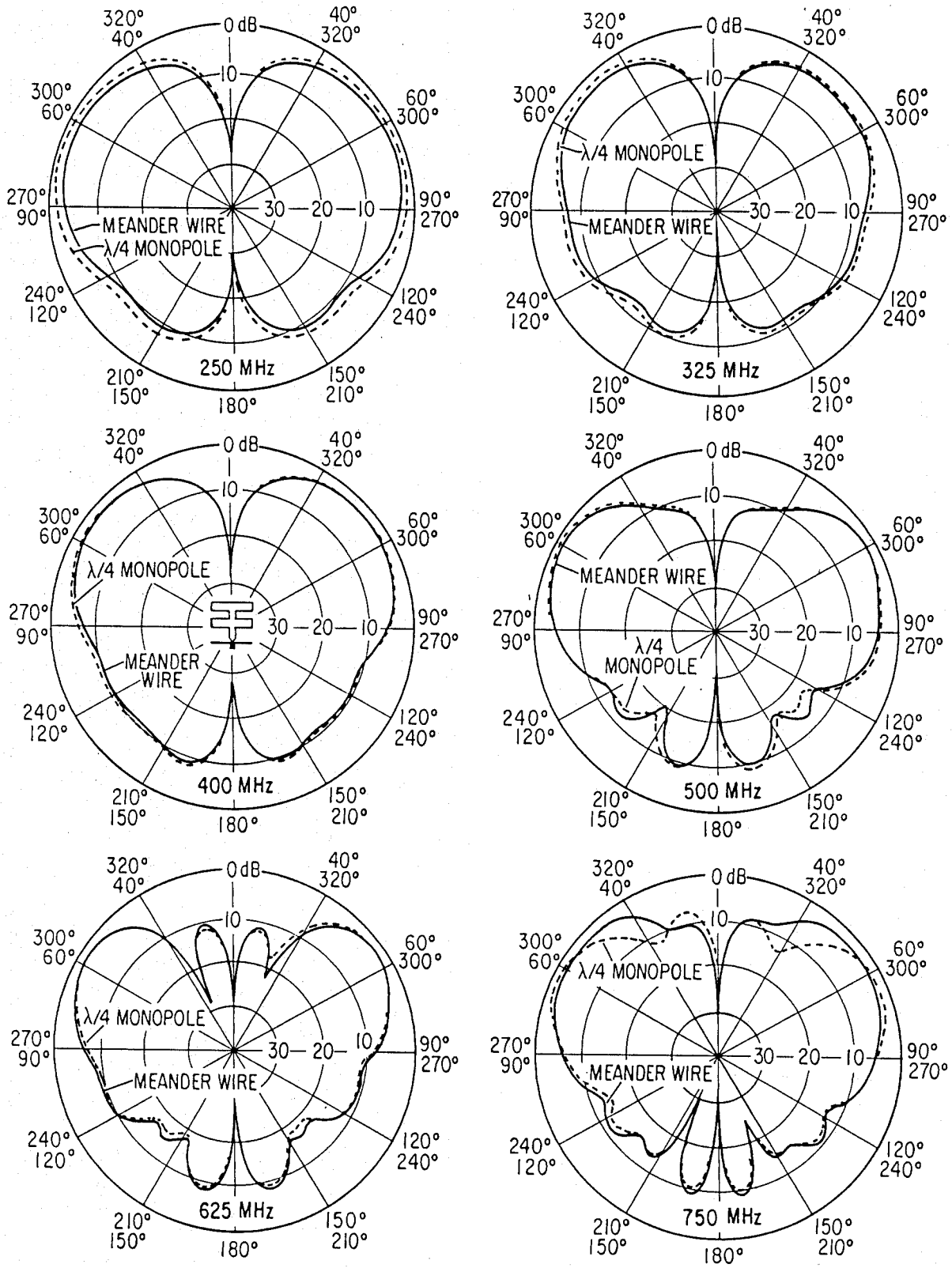
FIGS. 9A–9F compare the measured patterns of a meander monopole and a $\lambda/4$ monopole at 250, 325, 400, 500, 625 and 750 MHz.

FIG. 9 compres the radiation pattern of a meander monopole to the pattern of a straight-wire monopole over a 3:1 frequency bandwidth (250 to 750 MHz). FIG. 9 shows that the meander monopole maintains the typical monopole-type pattern over a 3:1 bandwidth. FIG. 9 also shows that the meander monopole is essentially the same level as the reference antenna, indicating good efficiency for a size-reduced antenna.

The invention may be adapted in many ways to accommodate particular design criteria. For example, the antenna can be fabricated from a printed circuit board using an etching process to form the conducting surface. Also, additional wires can be added to the dual meander wire configuration. In addition, the antenna may be tilted at an angle to the ground plane of less than 90 degrees. This permits the antenna to be utilized in a volume which is formed by surfaces that are not horizontal and vertical.

Although the invention has been described with respect to preferred embodiments, it is not to be so limited and includes changes and modifications that can be made which are within the full intended scope of the appended claims.

I claim:

1. A compact, broadband monopole antenna system designed to operate in a particular frequency bandwidth comprising:

(a) a driven element configured from two symmetrical meander wires having a plurality of alternating vertical sections V and horizontal sections L, having an overall height not exceeding ⅛ of a wavelength at the lowest frequency in said bandwidth;

(b) a first parasitic sleeve having alternating vertical sections H and horizontal sections W, and having an overall height not exceeding the height of said driven element and located within 1/20 of a wavelength at the highest frequency in said bandwidth away from the driven element; and (c) a means for connecting the driven element to a feed line.

2. A compact, broadband monopole antenna system as claimed in claim 1, wherein said means for connecting the driven element to the feed line is flexible.

3. A compact, broadband monopole antenna system as claimed in claim 1, wherein said horizontal sections L and W are bent at a point along their length, thereby compacting the antenna further.

4. A compact, broadband monopole antenna system designed to operate in a particular frequency bandwidth comprising:

(a) a driven element configured from two symmetrical meander wires having a plurality ofalternating vertical sections V and horizontal sections L, having an overall height not exceeding ⅛ of a wavelength at the lowest frequency in said bandwidth;

(b) a first parasitic sleeve having alternating vertical sections H and horizontal sections W, having an overall height not exceeding the height of said driven element and located within 1/20 of a wavelength at the highest frequency in said bandwidth away from said driven element;

(c) a second parasitic sleeve having alternating vertical sections F and horizontal sections G, and having an overall height not exceeding the height of said driven element and located within 1/20 of a wavelength at the height frequency in said bandwidth away from said driven element; and (d) a means for connecting the driven element to a feed line.

* * * * *